US011066877B2

(12) United States Patent
Olander

(10) Patent No.: US 11,066,877 B2
(45) Date of Patent: Jul. 20, 2021

(54) DIRECTIONAL DRILL SECURING DEVICE AND METHOD

(71) Applicant: TT Technologies, Inc., Aurora, IL (US)

(72) Inventor: John A. Olander, Aurora, IL (US)

(73) Assignee: TT Technologies, Inc., Aurora, IL (US)

( * ) Notice: Subject to any disclaimer, the term of this patent is extended or adjusted under 35 U.S.C. 154(b) by 0 days.

(21) Appl. No.: 15/880,001

(22) Filed: Jan. 25, 2018

(65) Prior Publication Data

US 2019/0226286 A1 Jul. 25, 2019

(51) Int. Cl.

| | |
|---|---|
| ***E21B 15/00*** | (2006.01) |
| ***E21B 15/04*** | (2006.01) |
| ***E21B 7/04*** | (2006.01) |
| ***E21B 19/15*** | (2006.01) |
| ***E21B 17/10*** | (2006.01) |
| ***E21B 19/24*** | (2006.01) |
| ***E21B 19/16*** | (2006.01) |
| ***E21B 17/046*** | (2006.01) |

(52) U.S. Cl.

CPC ..... *E21B 15/006* (2013.01); *E21B 7/046* (2013.01); *E21B 15/045* (2013.01); *E21B 17/046* (2013.01); *E21B 17/1042* (2013.01); *E21B 19/155* (2013.01); *E21B 19/16* (2013.01); *E21B 19/24* (2013.01)

(58) Field of Classification Search

CPC ..... E21B 15/006; E21B 15/04

See application file for complete search history.

(56) References Cited

U.S. PATENT DOCUMENTS

| | | | | |
|---|---|---|---|---|
| 6,216,803 | B1 * | 4/2001 | Deken | E21B 15/006 173/188 |
| 6,257,350 | B1 * | 7/2001 | Draney | E21B 7/046 173/187 |
| 6,497,296 | B1 * | 12/2002 | McGriff | E21B 7/046 175/162 |
| 2014/0144707 | A1 * | 5/2014 | Hartke | E21B 7/02 175/57 |
| 2015/0033664 | A1 * | 2/2015 | Sharpe | E21C 11/00 52/745.12 |

* cited by examiner

*Primary Examiner* — Tara Schimpf

(74) *Attorney, Agent, or Firm* — Schwegman Lundberg & Woessner, P.A.

(57) ABSTRACT

A directional drill securing device and associated methods are shown. Securing devices and methods shown include a plurality of staking devices on a single lateral side of a directional drill. Using examples shown, a lower force is required to drive multiple staking devices than would be needed for a larger staking device of equivalent area.

12 Claims, 5 Drawing Sheets

DIRECTIONAL DRILL SECURING DEVICE AND METHOD

TECHNICAL FIELD

Embodiments described herein generally relate to horizontal directional drills and methods. Specific examples may include securing systems for horizontal directional drills.

BACKGROUND

Directional drills are used for a number of types of jobs. A bore is made in the ground by piercing with a drill stem. In one use, new pipe may be drawn back through the bore that was formed. In this way, new pipe may be installed without the need to dig a trench in the ground first. For example, a utility line may be installed beneath a roadway without the need to close the road during the installation process. Progress of a directional drill stem may be monitored, and the tip of a drill stem may be steered to direct the bore over long distances. As a bore progresses, commonly, drill stem segments are added to increase a length of the drill stem until the bore reaches its intended destination. After the bore is complete, the drill stem may be retracted from the bore, and drill stem segments may be removed as the drill stem is retracted.

It is desirable to have a reliable system to secure the directional drill in place during a bore. It is further desirable to have a securing system that is configurable for different soil conditions, and uses less energy to use.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
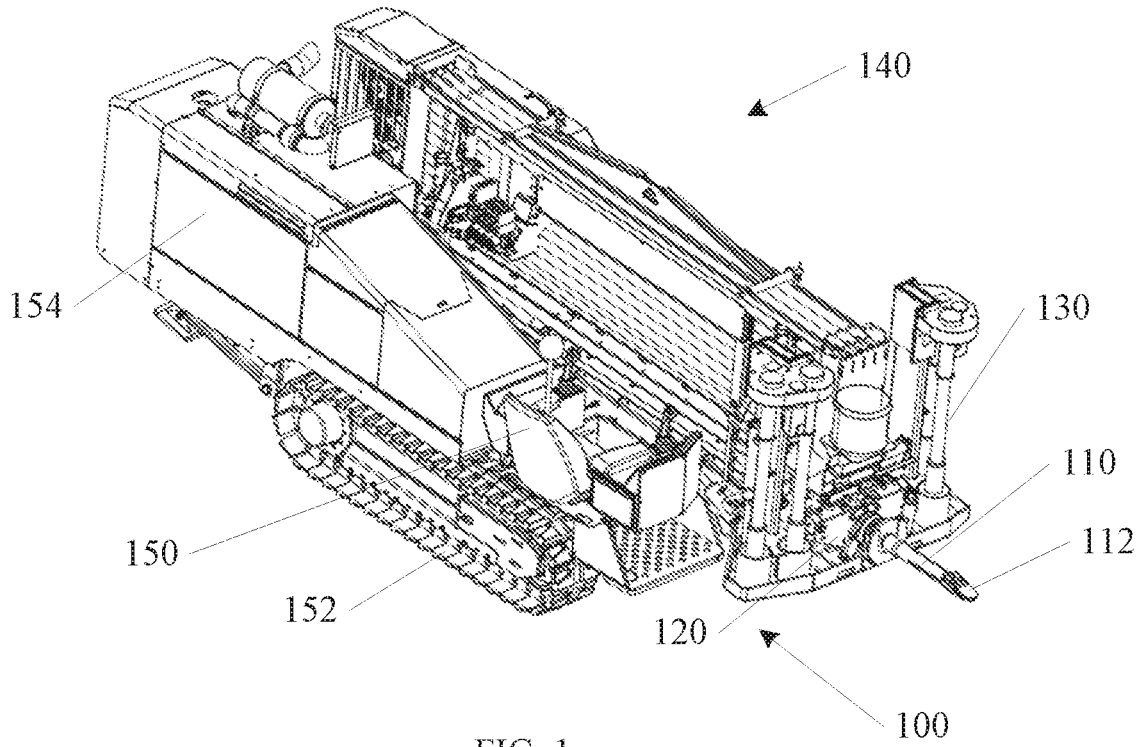
FIG. 1 is a directional drill in accordance with some embodiments of the invention.

FIG. 1 shows an example of a directional drill 100. The directional drill 100 includes a drill stem 110 including an attached sonde housing, and a drill bit 112 for piercing the ground and leading a directional drill bore operation, A drill stem loader 140 is shown coupled to the directional drill 100. The drill stem loader 140 is configured to pick drill stem segments (or drill rods) from a drill stem magazine and add stem segments to the stem 110 during a boring operation. The drill stem loader 140 is further configured to remove stem segments from the drill stem 110 and replace them in the drill stem magazine after the boring operation is complete, and the drill stem is being retracted from the bore.

A power supply 154 is coupled to the directional drill 100 to drive the drill stem 110, and to operate other aspects of the directional drill 100. A cockpit 150 is further included in the directional drill 100, the cockpit 150 including a number of controllers and gauges to control and monitor a drilling operation. In on example, a track system 152 is included on the directional drill 100 to move and position the directional drill 100. A stake down system 130 is also shown coupled to a front end of the directional drill 100 in the example of FIG. 1. Additional aspects of the stake down system 130 are described in more detail below. A directional drill vice 120 is further shown at a front end of the directional drill 100.

Figure 2:
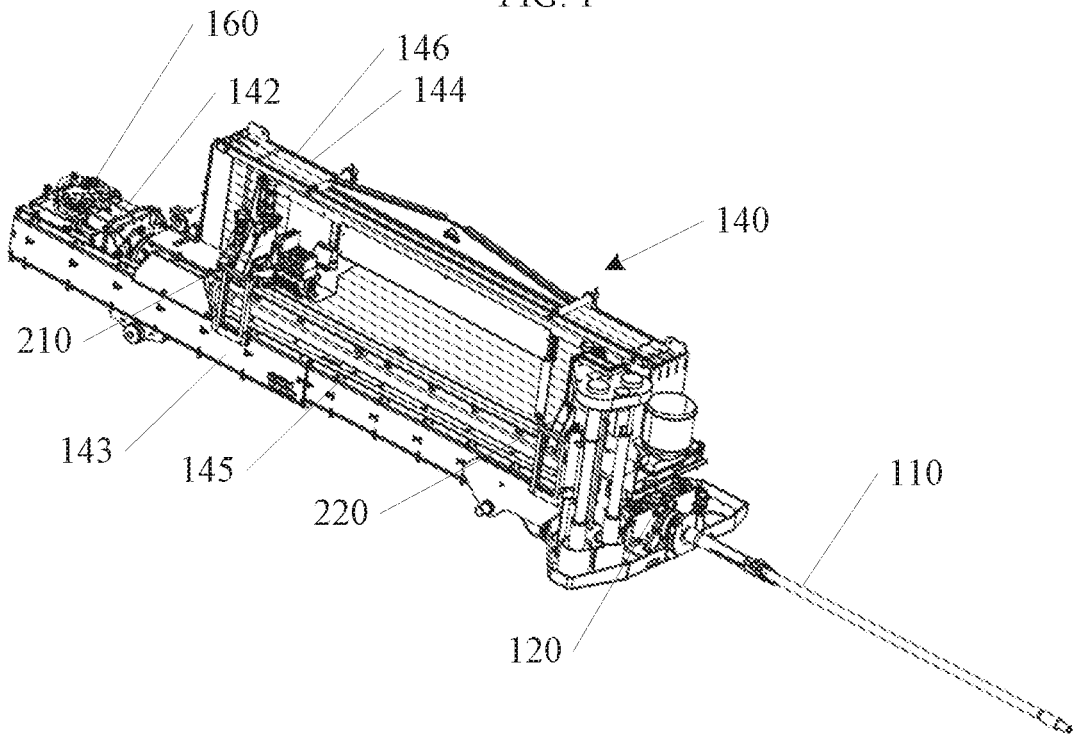
FIG. 2 is a portion of a directional drill in accordance with some embodiments of the invention.

FIG. 2 shows a portion of a directional drill 100 from FIG. 1, with a number of components removed to reveal more detail of a directional drill stem loader 140 according to an embodiment of the invention. The drill stem loader 140 includes a drill stem magazine 144, having a number of individual drill stem segments 146 loaded into the magazine 144.

A first linear actuator 210 and a second linear actuator 220 are shown adjacent to the drill stem magazine 144. In one example, the linear actuators 210, 220 are coupled to a pair of drill stem grippers. Although two linear actuators are shown, the invention is not so limited. Other configurations may include a single linear actuator, or more than two linear actuators. In one example, the directional drill vice 120 includes a slot that coordinates with the first linear actuator 210 and a second linear actuator 220 to load a drill stem segment laterally into the directional drill vice 120.

A drill head 142 is shown at a rear of the drill stem loader 140. The drill head 142 is mounted to a carriage frame 143 along a drill carriage track 145. In one example, a drill fluid supply system 160 is coupled to the directional drill 100, adjacent to the drill head 142. During a drilling operation, the drill head 142 is operated to both rotate the drill stem 110, and to drive the drill stem 110 forward into the ground. The drill stem vice 120 is shown at a front end of the drill stem loader 140. During a drilling operation, the directional drill vice 120 selectively holds or releases individual segments of the drill stem 110 to aid in the adding or removal of drill stem segments (by screwing or unscrewing a threaded joint at either end of the drill stem segment).

Figure 3A:
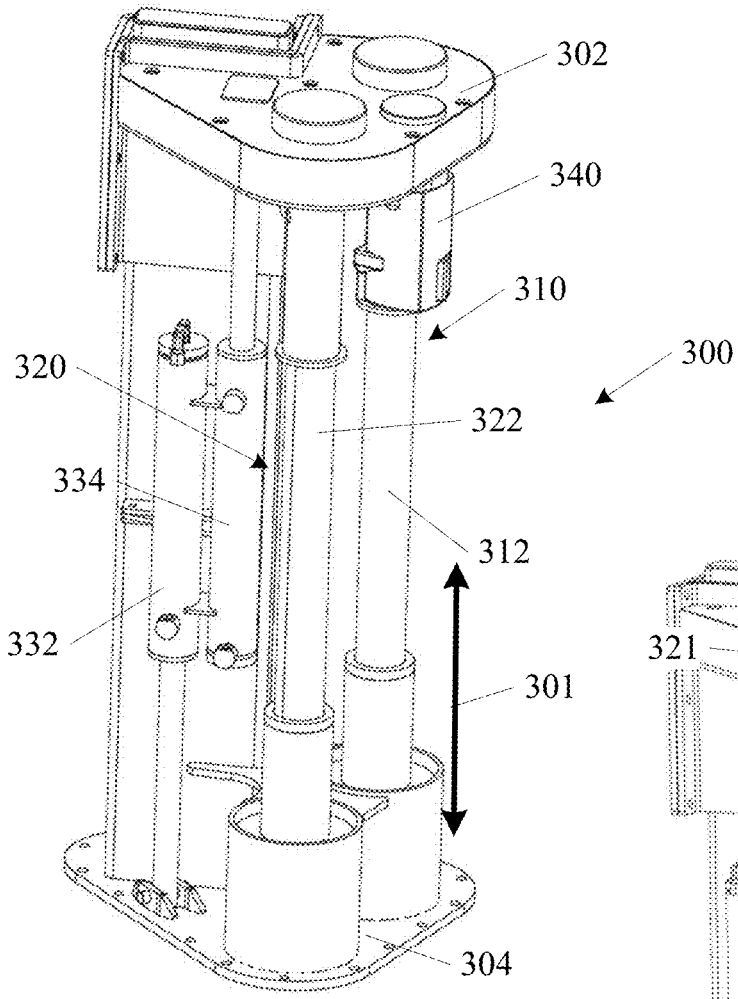
FIG. 3A is an isometric view of a component of a stakedown system in accordance with some embodiments of the invention.

FIG. 3A shows a stakedown device 300 according to one example. The stakedown device 300 includes a plurality of stake implements that are adapted to be located together on one lateral side of the drill carriage track 145. In the example shown, the stakedown device 300 includes a first staking implement 310, and a second staking implement 320. Additional detail of the respective staking implements 310, 320 are shown in cross section in FIG. 3B.

Figure 3B:
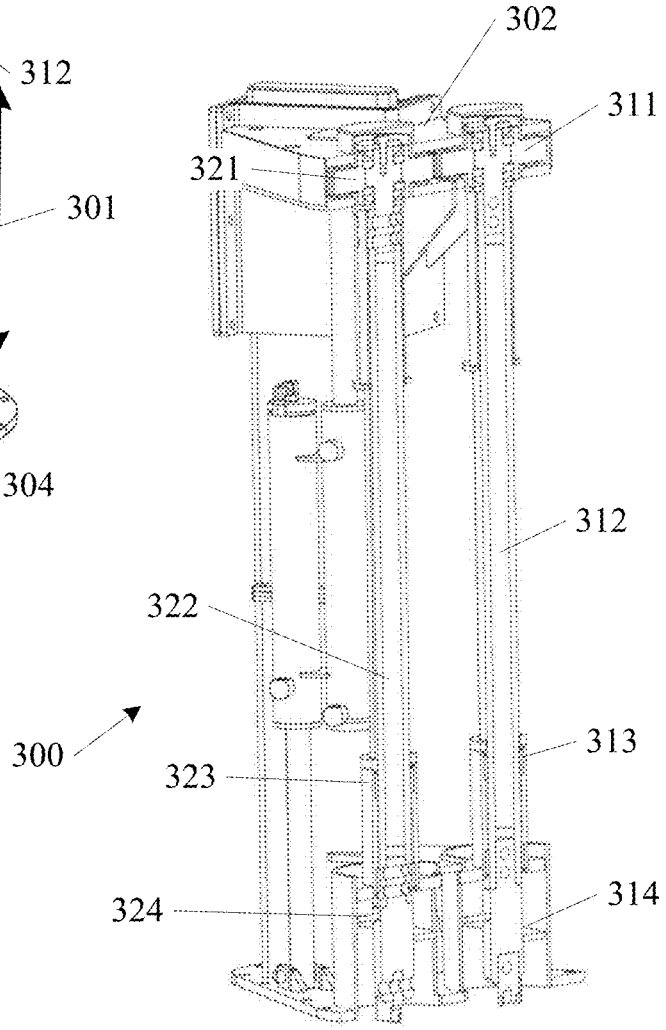
FIG. 3B is a cross section view of the component from FIG. 3A in accordance with some embodiments of the invention.

The first staking implement 310 includes a first auger 314, and the second staking implement 320 includes a second auger 324. Although spiral auger flights are shown in FIGS. 3A and 3B, the invention is not so limited. Other staking implements such as spikes or claws etc, are within the scope of the invention.

The stakedown device 300 includes a proximal end 302, and a distal end 304. In operation, the staking implements 310, 320 are selectively driven into or out of the soil along a range of motion 301. In one example, one or more actuators such as hydraulic cylinders may be used to drive the staking implements 310, 320 along the range of motion 301. Although hydraulic cylinders actuators are described, other examples of actuators include, but are not limited to, gear driven actuators, rack and pinion actuators, electric actuators, etc.

In the example shown, a pair of hydraulic cylinders 332, 334 are utilized. In the example shown, a first hydraulic cylinder 332 is mounted with a piston facing the distal end 304 of the stakedown device 300, and a second hydraulic cylinder 334 is mounted with a piston facing the proximal end 302 of the stakedown device 300.

One advantage of using a pair of hydraulic cylinders includes the ability to select a depth for the augers 314, 324 in a middle portion of the range of motion 301. While other systems of actuation may also be capable of selectable depth, the use of the pair of hydraulic cylinders 332, 334 provides depth selection ability without the use of more expensive components. Hydraulic cylinders are relatively inexpensive and more reliable compared to other actuators such as gear driven actuators. Another advantage of using a pair of hydraulic cylinders over the use of a single hydraulic cylinder includes reduced cost and improved reliability. The shorter length of each cylinder 332, 334 reduces the cost of the actuation system over a single, larger, hydraulic cylinder, and reduces the likelihood of a long piston bending due to high stress during operation.

In the auger examples shown in FIGS. 3A and 3B, each staking implement 310, 320 includes a rotating spindle 312, 322. The rotating spindles 312, 322 are coupled to the augers 314, 324 and rotate within distal bearing assemblies 313, 323. At the proximal end 304 of the stakedown device 300, a respective pair of drive gears 311, 321 are shown. Although a gear drive is illustrated as an example device for rotating the rotating spindles 312, 322, the invention is not so limited. Other examples include, but are not limited to, hydraulic motors, electric motors, belt drive, chain drive, etc.

A drive motor 340 is shown in FIG. 3A coupled to the drive gears 311, 321 of the staking implements 310, 320. In operation, rotation of the rotating spindles 312, 322 and the attached augers 314, 324 is accomplished by engaging the drive motor 340. Then extension or retraction of the staking implements 310, 320 is accomplished by actuation of one or more of the hydraulic cylinders 332, 334.

A plurality of smaller augers are easier to drive into the soil than a single large auger of equal auger surface area. In one example, by using a plurality of smaller augers, a similar staking force is achieved with a lower force required to drive the augers. In one example, an equal driving force is used to drive multiple augers, and an increased staking force is achieved as a result of using multiple augers. Again, while augers are used as an example other staking implements may be used with similar gains in efficiency.

Figure 4A:
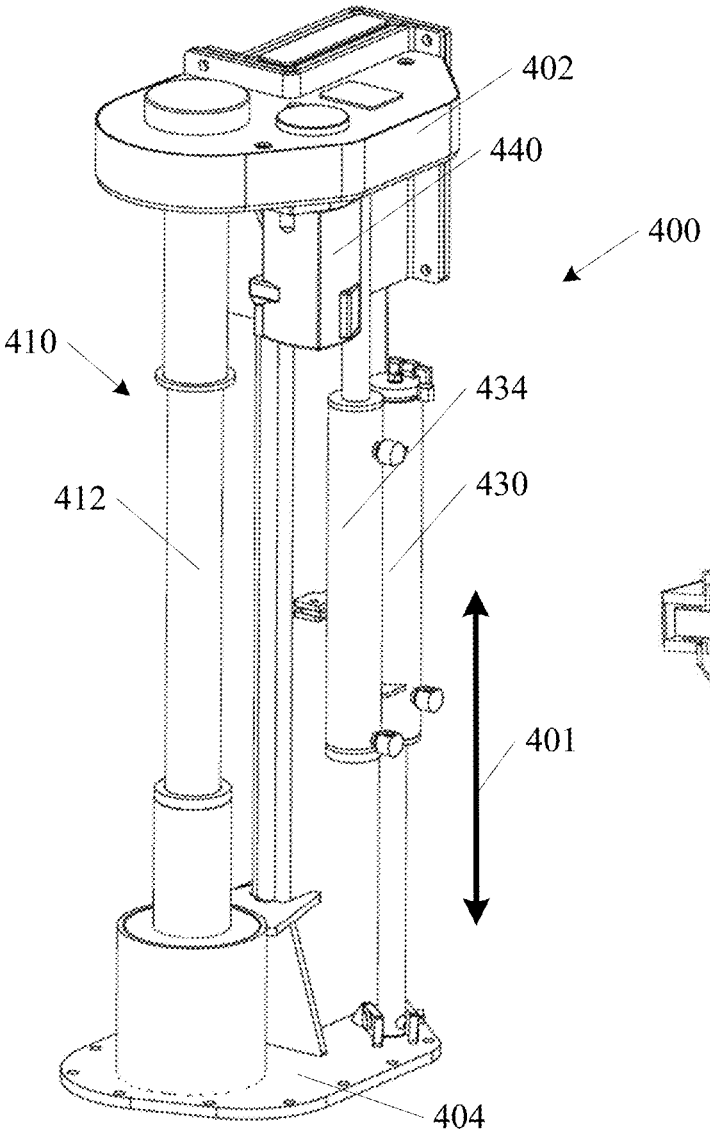
FIG. 4A is an isometric view of another component of a stakedown system in accordance with some embodiments of the invention.

FIG. 4A shows a stakedown device 400 according to one example. The stakedown device 400 includes a single stake implement 410 that is adapted to be located on one lateral side of the drill carriage track 145. In the example shown, the stakedown device 400 includes a staking implement 410, and an actuator to drive the staking implement 410. The stakedown device 400 includes a proximal end 402, and a distal end 404.

Figure 4B:
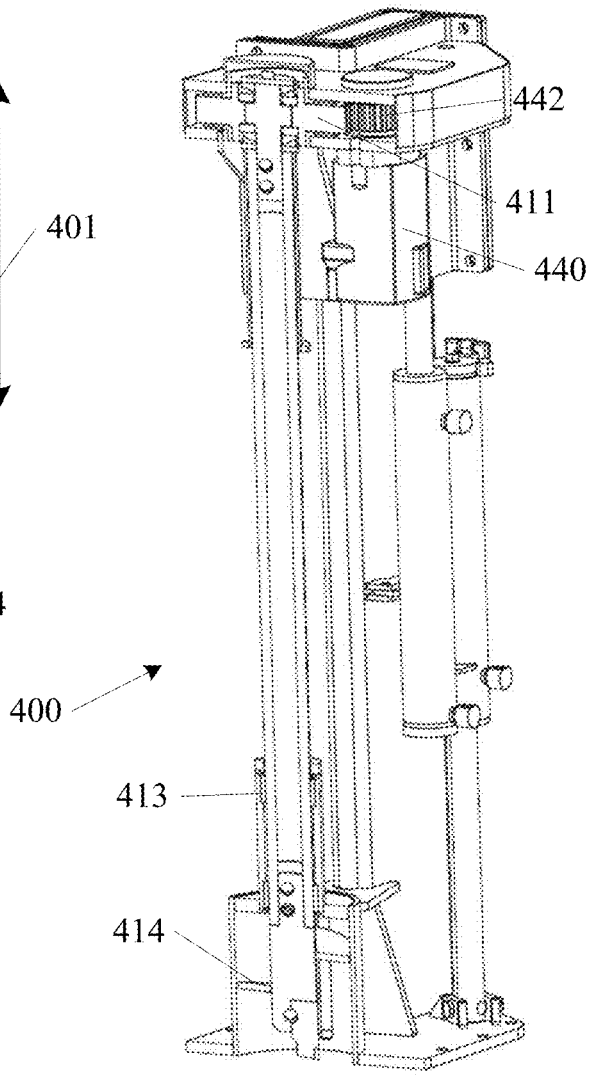
FIG. 4B is a cross section view of the component from FIG. 4A in accordance with some embodiments of the invention.

The staking implement 410 includes an auger 414. Similar to the examples discussed above in FIGS. 3A and 3B, although spiral auger flights are shown in FIGS. 4A and 4B, the invention is not so limited. Other staking implements such as spikes or claws etc, are within the scope of the invention. A spindle 412 is attached between a drive gear 411 and the auger 414. In the example shown, the spindle 412 is housed in an distal bearing assembly 413. Additional detail of the staking implement 410 is shown in cross section in FIG. 4B.

In operation, the staking implement 410 is selectively driven into or out of the soil along a range of motion 401. In the example shown, a pair of actuators 430, 434 drive the staking implement 410 along the range of motion 401. Although hydraulic cylinders actuators are described, other examples of actuators include, but are not limited to, gear driven actuators, rack and pinion actuators, electric actuators, etc.

A drive motor 440 and drive motor gear 442 is shown in FIGS. 4A and 4B coupled to drive gear 411 of the staking implement 410. In operation, rotation of the spindle 412 and the attached auger 414 is accomplished by engaging the drive motor 440. Then extension or retraction of the staking implement 410, is accomplished by actuation of one or more of the hydraulic cylinders 430, 434.

In the example directional drill 100 shown in FIG. 1, a single staking implement (similar to staking implement 410) is shown on a first lateral side of the drill carriage frame 143, and two staking implements (similar to staking implements 310, 320) are shown on a second lateral side of the drill carriage frame 143. However, the invention is not so limited. In other examples, multiple staking implements are located on both the first side and the second side of the drill carriage frame 143. As discussed above, a plurality of smaller augers are easier to drive into the soil than a single large auger of equal auger surface area. In one example, a number of staking implements on each lateral side of the drill carriage frame 143 is equal. In other examples, a first lateral side of the drill carriage includes a larger number of stake implements than the second lateral side.

One advantage of having a different number of staking implements on different lateral sides of a drill carriage includes the potential for several staking level options. For example, in loose soil conditions, all staking implements on both lateral sides may be used. The higher number of staking implements provides a higher staking force to accommodate the loose soil conditions. In hard soil conditions, it may be difficult to drive a staking implement into the soil. In this example, it may be desirable to drive only a single staking implement into the soil. Using examples of staking devices shown, in intermediate conditions, it may be desirable to drive an intermediate number of staking implements into the soil.

In the example of FIG. 1, three staking implements from both lateral sides of the directional drill 100 may be used in loose soil. One staking implement from a single side of the directional drill 100 may be used for hard soil conditions, and two staking implements from the other single side of the directional drill may be used in intermediate conditions.

Figure 5A:
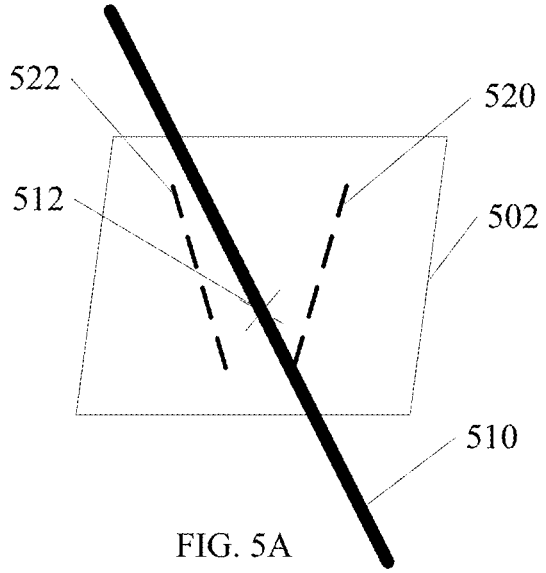
FIG. 5A is a diagram of orientation of stakedown system components in accordance with some embodiments of the invention.

FIG. 5A shows an example of an orientation of staking implements according to one embodiment of the invention. In the diagram of FIG. 5A, a drill stem 510 is shown by itself without other directional drill components, in order to illustrate orientation. The drill stem 510 passes through a plane 502 at point 512. The plane 502 is shown to illustrate an orientation of a first staking implement 520 and a second staking implement 522 with respect to each other, and the drill stem 510. In one example, the plane 502 may be oriented perpendicular to a ground surface. In one example, the plane 502 may be oriented perpendicular to an axis of the drill stem 510. In one example, the plane 502 may be fixed with respect to a directional drill. In one example, the plane 502 may be adjustable in orientation with respect to a directional drill.

Figure 5B:
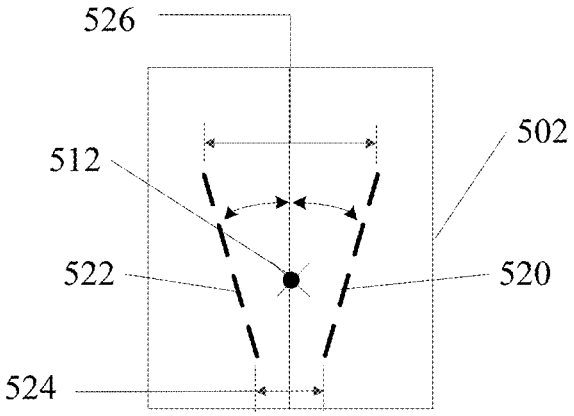
FIG. 5B is another diagram of orientation of stakedown system components from FIG. 5A in accordance with some embodiments of the invention.

The dashed lines shown in FIGS. 5A and 5B are used to represent axes of staking implements as they are driven into the ground. Examples of staking implements that travel into the ground along the dashed lines 520, 522 of FIGS. 5A and 5B may include the staking implements 300 and 400 as shown in either or both FIGS. 3A, 3B, and 4A, 4B.

The example of FIG. 5A shows the first staking implement 520 and the second staking implement 522 are not parallel to one another. Further, in the example of FIG. 5A, the first staking implement 520 and the second staking implement 522 are both within the plane 502, and are angled with respect to one another, and are not parallel. FIG. 5B shows that in one example, a bottom end of the first staking implement 520 and the second staking implement 522 are separated by a lower distance 524. A top end of the first staking implement 520 and the second staking implement 522 are separated by an upper distance 526. FIG. 5B shows the lower distance 524 is less than the upper distance 526. In this example, as the first staking implement 520 and the second staking implement 522 are driven into the soil, they will converge in the ground underneath the drill stem 510. One advantage of angling the staking implements 520, 522 towards each other includes less likelihood of accidentally hitting a buried utility. Another advantage of angling the staking implements 520, 522 towards each other includes improved holding strength. It has been found that in selected soil conditions, locating adjacent auger flights from two adjacent augers approximately 0.5 to 1.0 times an auger flight diameter from each other provides increased holding strength. Selecting an angle of the staking implements 520, 522 provides the ability to manufacture a directional drill for a given auger diameter with optimal holding strength.

In addition to angling staking implements beneath a drill stem, the same formula of adjacent staking implements may be used for two or more staking implements on the same side of a drill stem, such as shown in FIG. 1 above. As discussed above, locating adjacent auger flights from two adjacent augers approximately 0.5 to 1.0 times an auger flight diameter from each other provides increased holding strength over a single auger of equal auger flight area. In one example, any two augers, on any side of a drill stem, are located adjacent one another with auger flights from two adjacent augers approximately 0.5 to 1.0 times an auger flight diameter from each other. This configuration reduces driving force to deploy the augers over a single auger of equal auger flight area. Further, this configuration provides more holding force than a single auger of equal auger flight area. In one example, two augers are angled to provide this desired spacing. In other examples, the two adjacent augers are driven parallel to one another, but located such that flights from two adjacent augers approximately 0.5 to 1.0 times an auger flight diameter from each other.

Figure 6:
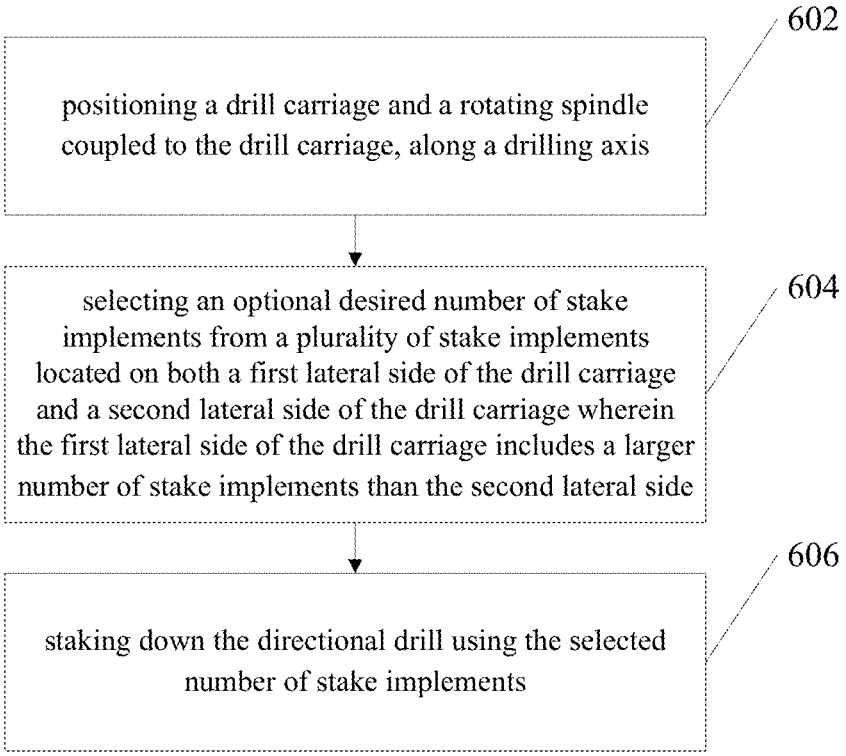
FIG. 6 is a flow diagram of a method of operating a directional drill vice in accordance with some embodiments of the invention.

FIG. 6 shows an example flow diagram of a method of operation according to one embodiment. In operation 602, a drill carriage and a rotating spindle coupled to the drill carriage are positioned, along a drilling axis. In operation 604, an optional desired number of stake implements are selected from a plurality of stake implements located on both a first lateral side of the drill carriage and a second lateral side of the drill carriage wherein the first lateral side of the drill carriage includes a larger number of stake implements than the second lateral side. In operation 606, the directional drill is staked down using the selected number of stake implements.

To better illustrate the method and apparatuses disclosed herein, a non-limiting list of examples is provided here:

Example 1 includes a directional drill. The directional drill includes a drill carriage, a rotating spindle coupled to the drill carriage, wherein the rotating spindle is adapted to translate along a surface of the drill carriage, and a stakedown system coupled to an end of the drill carriage. The stakedown system includes a first stake implement located on a first lateral side of the drill carriage, and a plurality of second stake implements located on a second lateral side of the drill carriage, opposite the first lateral side.

Example 2 includes the directional drill of example 1, wherein the first stake implement includes a plurality of first stake implements located on the first lateral side.

Example 3 includes the directional drill of any one of examples 1-2, wherein the plurality of first stake implements includes two first stake implements.

Example 4 includes the directional drill of any one of examples 1-3, wherein the plurality of second stake implements includes two second stake implements.

Example 5 includes the directional drill of any one of examples 1-4, wherein the first stake implement includes an auger.

Example 6 includes the directional drill of any one of examples 1-5, wherein the plurality of second stake implements includes at least one auger.

Example 7 includes the directional drill of any one of examples 1-6, wherein the plurality of second stake implements each include an auger.

Example 8 includes a directional drill. The directional drill includes a drill carriage, a rotating spindle coupled to the drill carriage, wherein the rotating spindle is adapted to translate along a surface of the drill carriage, and a stakedown system coupled to an end of the drill carriage. The stakedown system includes a plurality of stake implements located on both a first lateral side of the drill carriage and a second lateral side of the drill carriage, wherein the first lateral side of the drill carriage includes a larger number of stake implements than the second lateral side.

Example 9 includes the directional drill of example 8, wherein the first lateral side of the drill carriage includes one stake implement.

Example 10 includes the directional drill of any one of examples 8-9, wherein the second lateral side of the drill carriage includes two stake implements.

Example 11 includes the directional drill of any one of examples 8-10, wherein the plurality of stake implements includes at least one auger.

Example 12 includes the directional drill of any one of examples 8-11, wherein the plurality of second stake implements each include an auger.

Example 13 includes a method of operating a directional drill, including positioning a drill carriage and a rotating spindle coupled to the drill carriage along a drilling axis, selecting an optional desired number of stake implements from a plurality of stake implements located on both a first lateral side of the drill carriage and a second lateral side of the drill carriage wherein the first lateral side of the drill carriage includes a larger number of stake implements than the second lateral side, and staking down the directional drill using the selected number of stake implements.

Example 14 includes the method of example 13, wherein selecting an optional desired number of stake implements includes selecting a single stake implement on the first lateral side of the drill carriage.

Example 15 includes the method of any one of examples 13-14, wherein selecting an optional desired number of stake implements includes selecting two stake implements on the second lateral side of the drill carriage.

Example 16 includes the method of any one of examples 13-15, wherein staking down the directional drill includes rotating at least one auger into the ground.

Example 17 includes a directional drill, including a drill carriage, a rotating spindle coupled to the drill carriage, wherein the rotating spindle is adapted to translate along a surface of the drill carriage, and a stakedown system coupled to an end of the drill carriage. The stakedown system includes a first stake implement located on a first lateral side of the drill carriage, and a second stake implement located on a second lateral side of the drill carriage, opposite the first lateral side, wherein the first stake implement is angled with respect to the second stake implement.

Example 18 includes the directional drill of example 17, wherein the first stake implement and the second stake implement are angled towards each other beneath a drill stem axis.

Example 19 includes the directional drill of any one of examples 17-18, wherein the first stake implement and the second stake implement are angled towards each other within a plane.

Example 20 includes the directional drill of any one of examples 17-19, wherein the plane is oriented substantially perpendicular to a ground surface.

Example 21 includes the directional drill of any one of examples 17-20, wherein the first stake implement and the second stake implement are both augers having auger flight diameters.

Example 22 includes the directional drill of any one of examples 17-21, wherein the first stake implement and the second stake implement are configured to converge beneath the drill stem axis at a distance between auger flights of about 0.5 and 1.0 times the flight diameter.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A directional drill, comprising:

a drill carriage;

a rotating spindle coupled to the drill carriage, wherein the rotating spindle is adapted to translate along a surface of the drill carriage;

a stakedown system coupled to an end of the drill carriage, including:

a first stake implement including auger flights located on a first lateral side of the drill carriage; and a plurality of second stake implements including auger flights located on a second lateral side of the drill carriage, opposite the first lateral side;

wherein at least two stake implements are angled towards each other, wherein the at least two angled stake implements are configured to converge beneath the drill stem axis at a distance between auger flights of about 0.5 and 1.0 times a flight diameter.

2. The directional drill of claim 1, wherein the first stake implement includes a plurality of first stake implements located on the first lateral side.

3. The directional drill of claim 2, wherein the plurality of first stake implements includes two first stake implements.

4. The directional drill of claim 1, wherein the plurality of second stake implements includes two second stake implements.

5. A directional drill, comprising:

a drill carriage;

a rotating spindle coupled to the drill carriage, wherein the rotating spindle is adapted to translate along a surface of the drill carriage;

a stakedown system coupled to an end of the drill carriage, including a plurality of stake implements including auger flights located on both a first lateral side of the drill carriage and a second lateral side of the drill carriage; and wherein the first lateral side of the drill carriage includes a larger number of stake implements than the second lateral side;

wherein at least two stake implements are angled towards each other, wherein the at least two angled stake implements are configured to converge beneath the drill stem axis at a distance between auger flights of about 0.5 and 1.0 times a flight diameter.

6. The directional drill of claim 5, wherein the first lateral side of the drill carriage includes one stake implement.

7. The directional drill of claim 5, wherein the second lateral side of the drill carriage includes two stake implements.

8. The directional drill of claim 7, wherein the two stake implements each include an auger.

9. A method of operating a directional drill, comprising:

positioning a drill carriage and a rotating spindle coupled to the drill carriage along a drilling axis;

selecting an optional desired number of stake implements including auger flights from a plurality of stake implements located on both a first lateral side of the drill carriage and a second lateral side of the drill carriage wherein the first lateral side of the drill carriage includes a larger number of stake implements than the second lateral side; and staking down the directional drill using the selected number of stake implements, wherein at least two stake implements are angled towards each other, wherein the at least two angled stake implements are configured to converge beneath the drill stem axis at a distance between auger flights of about 0.5 and 1.0 times a flight diameter.

10. The method of claim 9, wherein selecting an optional desired number of stake implements includes selecting a single stake implement on the first lateral side of the drill carriage.

11. The method of claim 10, wherein selecting an optional desired number of stake implements includes selecting two stake implements on the second lateral side of the drill carriage.

12. A directional drill, comprising:

a drill carriage;

a rotating spindle coupled to the drill carriage, wherein the rotating spindle is adapted to translate along a surface of the drill carriage;

a stakedown system coupled to an end of the drill carriage, including:

a first stake implement including auger flights located on a first lateral side of the drill carriage, a second stake implement including auger flights located on a second lateral side of the drill carriage, opposite the first lateral side; and wherein the first stake implement is angled with respect to the second stake implement;

wherein the first stake implement and the second stake implement are angled towards each other beneath a drill stem axis;

wherein the first stake implement and the second stake implement are angled towards each other within a plane;

wherein the plane is oriented substantially perpendicular to a ground surface;

wherein the first stake implement and the second stake implement are configured to converge beneath the drill stem axis at a distance between auger flights of about 0.5 and 1.0 times a flight diameter.

* * * * *